United States Patent [19]

Wong et al.

[11] Patent Number: 4,476,046

[45] Date of Patent: Oct. 9, 1984

[54] BUFFERED ALKALI EARTH METAL SURFACTANT CAKES FOR DOSING DISPENSER

[75] Inventors: Louis F. Wong, Mason; Rosstain F. Sterling, Milford, both of Ohio; Thomas A. Borcher, Sr., Melbourne, Ky.

[73] Assignee: The Procter & Gamble Company, Cincinnati, Ohio

[21] Appl. No.: 452,544

[22] Filed: Dec. 23, 1982

[51] Int. Cl.[3] ..... C11D·17/00

[52] U.S. Cl. ..... 252/550; 252/90; 252/156; 252/174; 252/531; 252/DIG. 16

[58] Field of Search ..... 252/156, 90, 134, 174, 252/DIG. 16, 550, 531

[56] References Cited

U.S. PATENT DOCUMENTS 2,678,921 5/1954 Turck ..... 252/161
3,350,320 10/1967 Hewitt ..... 252/531

FOREIGN PATENT DOCUMENTS 242669 1/1963 Australia .

OTHER PUBLICATIONS

Properties and Technological Development of the Preparation of Alkyl Magnesium Sulfates and Detergent Based on Them, Chemical Abstract, vol. 74, No. 114472b.

*Primary Examiner*—Prince E. Willis
*Assistant Examiner*—Hoa Van Le
*Attorney, Agent, or Firm*—Richard C. Witte; Leonard Williamson; Ronald L. Hemingway

[57] ABSTRACT

A solid cake comprising 20% to 90% buffered alkali earth metal alkyl sulfate surfactant. Perfume, dye or salt, or any combination thereof are added. The surfactant and cakes made therefrom have pH's of from about 6 to about 10. The buffered surfactants and their cakes have improved stability and improved longevity. Preferred cakes are made with buffered magnesium alkyl sulfate.

33 Claims, No Drawings

BUFFERED ALKALI EARTH METAL SURFACTANT CAKES FOR DOSING DISPENSER

TECHNICAL FIELD

The present invention relates in general to a solid surfactant cake. The cakes are particularly useful in conjunction with a toilet tank dosing dispenser which automatically dispenses a ration of surfactant, perfume, and/or dye, and optionally other ingredients to the bowl of a toilet, responsive to the flushing of the toilet.

BACKGROUND ART

In treating toilet flush water with chemicals in order to produce desirable effects such as bowl aesthetics, cleaning, disinfection, deodorization, aerosol reduction, etc., it is desirable that the chemicals be dispensed into the flush water automatically each time the toilet is flushed. The prior art discloses numerous devices which have been designed for this purpose. Exemplary of such devices are disclosed in:

- U.S. Pat. No. 4,171,546, Dirksing, issued Oct. 23, 1979;
- U.S. Pat. No. 4,186,856, Dirksing, issued Feb. 5, 1980;
- U.S. Pat. No. 4,200,606, Kitko, issued Apr. 29, 1980;
- U.S. Pat. No. 4,208,747, Dirksing, issued June 24, 1980;
- U.S. Pat. No. 4,216,027, Wages, issued Aug. 5, 1980;
- U.S. Pat. No. 4,246,129, Kacher, issued Jan. 20, 1981;
- U.S. Pat. No. 4,247,070, Dirksing, issued Jan. 27, 1981;
- U.S. Pat. No. 4,248,827, Kitko, issued Feb. 3, 1981;
- U.S. Pat. No. 4,251,012, Williams et al., issued Feb. 17, 1981;
- U.S. Pat. No. 4,253,951, McCune, issued Mar. 3, 1981;
- U.S. Pat. No. 4,281,421, Nyquist et al., issued Aug. 4, 1981;
- U.S. Pat. No. 4,283,300, Kurtz, issued Aug. 11, 1981;
- U.S. Pat. No. 4,302,350, Callicott, issued Nov. 24, 1981;
- U.S. Ser. No. 355,984, Mueller et al., filed Mar. 8, 1982; and European Pat. Appln. 0,005,286, Nyquist, published Nov. 14, 1979, all of which are incorporated herein by reference.

Particularly desirable devices are those comprising a solid cake composition. In this type of device a measured amount of water enters the device during one flush cycle and remains in contact with the cake between flushes, thereby forming a concentrated solution of the composition which is dispensed into the flush water during the next flush. The advantages of such devices are that the chemical composition can be packaged and shipped in more concentrated form than aqueous solutions of the chemicals. Also, the problems of liquid spillage resulting from breakage of the dispensers during shipment or handling is eliminated. Especially preferred devices for automatic dispensing of chemicals from solid cake compositions into the toilet are those described in U.S. Pat. No. 4,171,546, Dirksing, issued Oct. 23, 1979; U.S. Pat. No. 4,208,747, Dirksing, issued June 24, 1980; U.S. Pat. No. 4,186,856, Dirksing, issued Feb. 5, 1980; all of which are incorporated by reference. A preferred version of the dispenser is used in BRIGADE$^R$, an automatic toilet bowl cleaner sold by The Procter & Gamble Company.

Prior art surfactant cake compositions used in the "Dirksing" dispensing devices are disclosed in U.S. Pat. No. 4,308,625, Kitko, issued Jan. 5, 1982; U.S. Pat. No. 4,310,434, Choy and Greene, issued Jan. 12, 1982; and U.S. Pat. No. 4,278,5671, Choy, issued July 14, 1981, entitled "Surfactant Cake Compositions;" all of which are incorporated herein by reference. The surfactants provide cleaning and sudsing in the toilet bowl and also serve to dispense other components of the compositions such as dyes, perfumes, organic resins, etc. Anionic surfactants, especially the organic sulfates and sulfonate types, are used in these compositions because of their availability, low cost and excellent cleaning and dispensing properties.

Water-soluble inert salts such as alkali metal chlorides and sulfates are used in such compositions to act as a "filler" so that the composition can be formed into cakes of desirable size without using excessive amounts of active ingredients. The predominant ingredients of the cake compositions are usually the surfactant, perfume and the filler salt. Anionic, nonionic, ampholytic, zwitterionic or cationic surfactants are used. The surfactant or surfactant mixture should be solid at temperatures up to about 100° F. (40° C.). Anionics and nonionics and mixtures thereof are useful. Anionics are the most preferred.

The prior art anionic surfactant cakes can be described as essentially the water-soluble alkali metal salts, of organic sulfuric reaction products having in their molecular structure an alkyl or an alkylaryl radical containing from 8 to 22 carbon atoms.

A major problem in this art has been short and/or erratic longevity of surfactant cakes. "Hot spots," for example, cause rapid and uneven dissolution and decreased cake stability and longevity. A hot spot is localized decomposition of the surfactant and is characterized by a pH of 1 or 2 and a high concentration of free fatty alcohol. Another problem is related to the incorporation of higher levels of perfume into surfactant cake formulations while maintaining desired firmness.

SUMMARY OF THE INVENTION

The present invention is directed to solid cake compositions which comprise from about 20% to 90% of a buffered surfactant, preferably one selected from the group consisting of alkali earth metals and selected nonalkali metal alkyl sulfates; from 0% to 30% perfume; from 0% to 40% salt and from 0% to 12% dye. Aesthetic surfactant cakes for dosing dispensers preferably have at least about 10% of any combination of filler salt, perfume and/or dye. The preferred buffer for the surfactant system is sodium carbonate which is present in the cake at a level of from about 0.5% to about 3% parts per part of surfactant. The presence of the buffer retards "hot spots" formation and improves cake stability. The cake weighs from 10 grams to 120 grams and has a density of from about 0.8 to about 1.5. The pH of the surfactant cake is from about 6 to about 10.

One object of the present invention is to provide a surfactant cake for an automatic dosing dispenser which has improved stability and longevity. Another object of the present invention is to provide a surfactant cake formulation which includes a higher level of perfume while maintaining improved longevity. Yet another object of the present invention is to provide a method of making a more stable surfactant cake for a dosing dispenser.

DETAILED DESCRIPTION OF THE INVENTION

According to the present invention it has been found that superior cakes can be made with certain buffered anionic organic surfactants selected from certain alkali earth metal alkyl sulfate, selected transition metal alkyl sulfates and other selected nonalkali metal alkyl sulfates. The detergent cakes are used in dosing dispensers for toilets. These new cakes remain sufficiently soluble to perform their required functions and have improved longevity over surfactant cakes based on alkali metals.

The anionic surfactants of the water-soluble alkali metal salts are very soluble. In formulating aionic surfactant-containing cakes or cakes for use in automatic toilet dispensing devices, in order to increase surfactant cake longevity, nonalkali metal alkyl sulfates are used.

The following description of the invention, the manner and process of making and using it, is set forth using magnesium alkyl sulfate as the preferred embodiment. It will be understood that other alkali earth metal alkyl sulfates and other selected nonalkali metal alkyl sulfates can be used.

Cakes can contain alkali metal alkyl sulfates at levels of 2% to 25%, more or less, of the total cake surfactant content.

All percentages and ratios herein are "by weight" unless specified otherwise. The compositions herein will be described with particular reference to their use in conjunction with dispensers which dispense chemicals into the flush water of toilets, although it is to be understood that said compositions can be used in other applications where a solid cake surfactant composition is desired.

The new cake compositions comprise from about 20% to about 90% of an alkali earth metal and/or suitable transition metal alkyl sulfate surfactant wherein the alkyl group has a carbon chain length of from 8 to 22 carbon atoms, preferably from 10 to 16 carbon atoms. Preferred surfactants are buffered; magnesium alkyl sulfate, calcium alkyl sulfate, barium alkyl sulfate, aluminum alkyl sulfate, tin alkyl sulfate, and zinc alkyl sulfate. The cakes of this invention contain at least 1.5% of dye and/or perfume. Some cake compositions contain from 40% to 70% surfactant, from 10% to 20% perfume, from 5% to 18% of the water-soluble salt, and from 1.5% to 5% dye. The cakes preferably weigh from 20 grams to 80 grams.

It has been found that cakes having a pH of from 6 to about 10 are stable. Preferred cake have pH's from 7 to 9.5.

The cakes of this invention preferably have a moisture content of 1% to 10%, more preferably 1% to 5%.

The Buffered Surfactant

The alkali earth metal and transition metal alkyl sulfate surfactants themselves are known compounds. However, the solid all synthetic buffered cake compositions of this invention are believed to be novel.

The surfactants of this invention are made by reacting an alkali earth metal salt such as magnesium sulfate with an alkali metal alkyl sulfate salt (or alkyl sulfuric acid), such as sodium lauryl sulfate (or lauryl sulfuric acid). The reaction products are buffered with an effective amount of a buffer, such as 0.5% to 3% sodium carbonate by weight of magnesium alkyl sulfate. The buffered reaction product is then dried from buffered aqueous mixture to yield dried magnesium alkyl sulfate having a pH of from about 6 to about 10, preferably 7 to 9.5. The reaction product may be dried on a drum dryer, spray tower, vacuum dryer, etc., so long as the dried surfactant product has a pH of from 6 to about 10, preferably from 7 to about 9.5.

The reaction product is buffered using an effective amount of a suitable buffer having a pKa in the range of 6 to 10, preferably 7 to 9.5. The reaction product is dried from a buffered aqueous solution having 1.5 to 2.5 parts water per part of total solids. The reaction products are preferably dried from a buffered aqueous solution having 1.7 to 2.3 parts water per part of total solids. The preferred buffer is sodium carbonate. Phosphates, borates, pyrophosphates, and other buffers having pKa's in the range of 6 to 10 are suitable buffers.

The reaction product is concentrated to about 32% solids and is then dried to a moisture content of 1% to 7%, and preferably 2% to 5% water. Preferably the concentrate is drum dried at a temperature of from about 120° C. to about 160° C., more preferably about 120° C. to about 140° C.

Suggested Steps for Making the Surfactant and Cakes of This Invention

1. Charge a Crutcher mixer equipped with agitation and recirculation with an alkali metal alkyl sulfate (e.g., sodium lauryl sulfate).
2. Add more or less of a stoichiometric amount of magnesium sulfate with agitation and recirculation.
3. Mix and recirculate.
4. Add a sufficient amount of a buffer salt, preferably sodium carbonate, to insure that the pH of the reaction solution is 6 to 10, preferably 7 to 9.5.
5. Mix and recirculate for about 30 minutes.
6. Pump the buffered solution to a storage tank (optional).
7. Pump the buffered reaction product solution onto drum roll dryers having a temperature of from about 120° C. to about 140° C. Drying conditions should maintain the pH of 6 to 10.
8. If fatty alcohol is to be added, determine how much is in the dried product of Step 7.
9. Agglomerate in an amalgamator the dried flakes of Step 7 along with other ingredients such as extra filler salt, perfume, dyes, free fatty alcohol etc. Amalgamate.
10. Plod the amalgamated mixture of Step 8 and then extrude into strips.
11. Cut into cakes.
12. Place the cakes into dosing dispensers and seal.

Perfumes

Perfumes are an important ingredient for surfactant cake compositions. Cakes can be made with perfume and no dye. Perfume is usually used at levels of from 0% to 30%, but levels of 5% and 25% and 10% to 20% perfumes are preferred. In U.S. Pat. No. 4,246,129, Kacher, issued Jan. 20, 1981 (incorporated herein by reference), certain perfume materials are disclosed which perform the added function of reducing the solubility of anionic sulfonate and sulfate surfactants. At higher levels of perfumes, e.g., over 12%, the softness of the plug could be a problem. This is particularly so in compositions based on alkali metal alkyl sulfate surfactants.

Cake Firmness

The firmness of the cake is measured by the use of a penetrometer. Acceptable penetrometer readings are from 40 to 110 and preferably between 40 and 80 using a Lab-Line Universal Penetrometer equipped with wax penetration needle ASTM D1321, Cat. No. 4101.

Operation:

Level base and place 100 g. and 50 g. weights on plunger top. Place bar on cut end beneath penetrometer needle, raised to the zero position. Lower needle (via elevator screw) until needle just touches plug end. Depress trigger for 10 seconds (needle will lower into cake, then release. To read hardness, lower depth gauge bar until it just touches plunger.

Hardness readings are taken directly from the gauge, in units of tenths of millimeters.

Raise the needle to zero position, remove plug, and record plug hardness temperature.

The Salts

The inert salts (filler salts) used in the compositions of the present invention can be any water-soluble inorganic or organic salt or mixtures of such salts which do not destabilize the surfactant. For the purposes of the present invention, "water-soluble" means having a solubility in water of at least 1 gram per 100 grams of water at 20° C. Examples of suitable salts include various alkali metal and/or alkali earth metal sulfates, chlorides, borates, bromides, fluorides, phosphates, carbonates, bicarbonates, citrates, acetates, lactates, etc.

Specific examples of suitable salts include sodium sulfate, sodium chloride, potassium sulfate, sodium carbonate, lithium chloride, lithium sulfate, tripotassium phosphate, sodium borate, potassium bromide, potassium fluoride, sodium bicarbonate, magnesium sulfate, magnesium chloride, sodium citrate, sodium acetate, magnesium lactate, and sodium fluoride. The preferred salts are inorganic salts preferably the alkali metal sulfates and chlorides. Particularly preferred salts, because of their low cost are sodium sulfate and sodium chloride. The salts are present in the compositions at levels of from 0% to 40%, preferably 10% to 20%.

Lithium sulfate in cake composition at a level of from 0.1% to 0.8% by weight of the cake has been found to be an effective stability agent for the cake in the presence of trace hypochlorite solution. It provides solubility control benefits. A preferred range is 0.2% to 0.7%.

The Dyes

Dyes may be included at levels of from about 0.5% to 12%, preferably 1.5% to 5%. Cakes can be made with 1.5% dye and no perfume. Examples of suitable dyes are Alizarine Light Blue B (C.I. 63010), Carta Blue VP (C.I. 24401), Acid Green 2G (C.I. 42085), Astrogen Green D (C.I. 42040), Supranol Cyanine 7B (C.I. 42675), Maxilon Blue 3RL (C.I. Basic Blue 80), Drimarine Blue Z-RL (C.I. Reactive Blue 18), Alizarine Light Blue H-RL (C.I. Acid Blue 182), FD&C Blue No. 1 and FD&C Green No. 3. (See the patents of Kitko, U.S. Pat. No. 4,200,606, issued Apr. 29, 1980, and U.S. Pat. No. 4,248,827, issued Feb. 3, 1981, both incorporated herein by reference.) C.I. refers to Color Index.

Free Fatty Alcohols

Fatty alcohols increases the longevity of the magnesium surfactant cakes of this invention substantially. See Tables 1 and 2. Cakes comprising 1% to 15% coconut fatty alcohol are preferred. Cakes having 3% to 10% are most preferred.

Fatty alcohols having carbon chain lengths of 8 to 18 are preferred; more preferred are those with 12 to 16 carbon atom chains.

Other Optional Ingredients

Various optional materials may be included in the compositions herein. See U.S. Pat. No. 4,278,571, Choy, issued July 14, 1981, for an extensive list of them.

Bleach Cake

The present surfactant cake can be used with a bleach cake. The preferred bleach cake comprises 95% HTH and 5% lithium sulfate in a particle retaining filter sleeve. Details of this bleach cake are disclosed in commonly owned U.S. Pat. Appln. Ser. No. 452,469, of L. F. Wong for "Particle Retaining Means for Bleach Cake in Passive Dosing Dispenser," filed of even date, incorporated herein by reference.

The cake is formed into shapes with dimensions appropriate to fit the cake compartment of the gravity feed dosing dispenser which holds the cake.

Dispensing Means

Dispensing means which can be used to dispense compositions of the present invention into the toilet flush water are exemplified by those described in U.S. Pat. Nos. 3,831,205, 3,341,074, 3,504,384, 2,688,754, 4,036,407, 4,171,546, 4,208,747, and 4,186,856, above noted. Details of the preferred dispensing means are disclosed in commonly owned U.S. Pat. Appln. Ser. No. 452,543 of Dirksing et al. for "Article and Method for Maintaining More Even Concentrations of Bleach in a Passive Dosing Dispenser," filed of even date, incorporated herein by reference.

THE EXAMPLES

Preferred embodiments of the invention will in illustrated by the following examples.

In the examples and the tables below, unless otherwise stated, all $Mg(AS)_2$ references mean buffered magnesium lauryl sulfate.

EXAMPLE I

This example sets out the procedure for making stable magnesium alkyl sulfate base cake. The following formula was put into a Crutcher with agitation and recirculation:

| Ingredients | Parts |
|---|---|
| NaAS (29.5% active)* | 88.24 |
| $MgSO_4.7H_2O$ | 11.10 |
| $Na_2CO_3$ | 0.66 |
| | 100.00 |

*EQUEX-S, manufactured by The Procter & Gamble Company, is a 29% solution of sodium lauryl sulfate The Crutcher reaction mixture consisted of:

| Ingredients | Parts |
|---|---|
| $Mg(AS)_2$ | 25.06 |
| $Na_2SO_4$ | 6.42 |
| $Na_2CO_3$ | 0.66 |
| $H_2O$ | 67.86 |
| | 100.00 |

This reaction mixture had a pH of about 9.5.

After about 30 minutes of mixing the buffered mixture was pumped to drum roll dryers, having a temperature of about 130° C., and dried into flakes. The flakes had the following composition:

| Ingredients | Parts |
|---|---|
| $Mg(AS)_2$ | 76.41 |
| $Na_2SO_4$ | 19.57 |
| $NA_2CO_3$ | 2.01 |
| $H_2O$ | 2.01 |
| | 100.00 |

These flakes had a pH of about 9.5.

The flakes were agglomerated with perfume, fatty alcohol, and dye using the following formula:

| Ingredients | Parts |
|---|---|
| Flakes | 74.3 |
| Perfume | 18.0 |
| Fatty Alcohol | 5.0 |
| Dye | 2.7 |
| | 100.0 |

The fatty alcohol used was coconut fatty alcohol. It was noted that some free fatty alcohol was brought into the flakes with EQUEX-S and some may be generated by decomposition during the drying process. Free alcohol analyses were run on the dried flakes prior to the agglomeration step, then enough fatty alcohol was added to make a total of about 5.0% fatty alcohol in the finished product.

The agglomeration was mixed well and plodded three times and then extruded through a 1.3 cm×4.9 cm orifice into strips. The strips were then cut into cakes. The cakes had a pH of about 9.5. They reflect buffer at a level of about 2.7% by weight of the surfactant. The finished product composition reflects sodium sulfate (0.65%) and sodium chloride (0.14%) brought in with the EQUEX-S:

| Ingredients | Parts |
|---|---|
| $Mg(AS)_2$ | 54.72 |
| Perfume | 18.00 |
| $Na_2SO_4$ | 15.74 |
| Fatty Alcohol | 5.60 |
| Dye | 2.70 |
| $Na_2CO_3$ | 1.48 |
| $H_2O$ | 1.48 |
| NaCl | 0.28 |
| | 100.00 |

EXAMPLE II

Following the procedure set out in Example I, a cake was made having 54.90 parts magnesium alkyl sulfate, 18 parts perfume, 15.74 parts sodium sulfate, 5.0 parts fatty alcohol, 2.70 parts dye, 0.42 parts lithium sulfate, 1.48 parts sodium carbonate, 1.48 parts water and 0.28 parts sodium chloride. The dried agglomerated formula consisted of:

| Ingredients | Parts |
|---|---|
| Flakes | 71.8 |
| Perfume | 18.0 |
| Fatty Alcohol | 5.0 |

-continued

| Ingredients | Parts |
|---|---|
| $Li_2SO_4.H_2O$ | 0.5 |
| Dye | 2.7 |
| Water | 2.0 |
| | 100.0 |

The cakes of this example had a pH of about 9.5. Cake density of 1.14 g/cm$^3$. The cakes were very stable and had good longevity.

Improved Cakes with Free Fatty Alcohol

In Table 1 preferred cake composition ranges are set out along with longevity ranges. Table 2 sets out preferred cake compositions. In all of the tables below the cakes tested weigh about 65 gms each. The dosing dispenser used is disclosed in U.S. patent application Ser. No. 452,469 of L. F. Wong, filed of even date, for "Particle Retaining Means for Bleach Cake in Passive Dosing Dispenser," incorporated herein by reference.

As used herein, the term "coconut fatty alcohol" means fatty alcohols containing $C_8$ to $C_{18}$, but mostly $C_{12}$ to $C_{14}$ carbon chains, and includes natural and synthetic fatty alcohols so defined.

TABLE 1

| Ingredients | Ranges (%) I | Ranges (%) II |
|---|---|---|
| Free Fatty Alcohol, $C_{12}$–$C_{14}$ | 1–15 | — |
| Mg-$(AS)_2$, $C_{12}$–$C_{14}$ | 20–75 | 20–75 |
| Perfume, Pine Cone (P & G) | 9–25 | 9–25 |
| Dye, Acid Blue #9 | 2–5 | 1–30 |
| $Na_2SO_4$ | 1–30 | 1–30 |
| $H_2O$ | .5–7 | .5–7 |
| $Na_2CO_3$ | .5–5 | .5–5 |
| Longevity Range in flushes- 70 flushes = 1 week at 16° C. | 300–1500 flushes | 200–400 flushes |

Referring to Table 1, note that cake compositions of Range I, which contained 1% to 15% free coconut fatty alcohol, have improved longevity. See Table 2 for a specific comparison. The cake containing fatty alcohol has 250 more flushes than the cake without it. A week of use equals about 70 flushes.

TABLE 2

| Ingredients | Preferred Compositions (%) I | Preferred Compositions (%) II |
|---|---|---|
| Free Fatty Alcohol, $C_{12}$–$C_{14}$ | 4.8 | — |
| Mg-$(AS)_2$, $C_{12}$–$C_{14}$ | 56.0 | 60.7 |
| Perfume, Pine Cone (P & G) | 18.0 | 18.0 |
| Dye, Acid Blue #9 | 2.7 | 2.7 |
| $Na_2SO_4$ | 15.0 | 15.0 |
| $H_2O$ | 1.9 | 2.0 |
| $Na_2CO_3$ | 1.6 | 1.6 |
| Longevity of Cakes | 700 flushes | 350 flushes |

Improved Cakes with Mg-$(AS)_2$ vs. NaAS Cakes

The data reported in the following tables dramatize the longevity and perfume absorption benefits of Mg-$(AS)_2$ base cakes over NaAS base cakes. In Table 3, the scopes of the compositions (ranges) are set out. In Table 4, the preferred compositions are set out. The cakes each weighed about 65 gms.

TABLE 3

| Cake Ingredients | Ranges (%) I | Ranges (%) II |
|---|---|---|
| Mg-(AS)$_2$, $C_{12}$–$C_{14}$ (I) | 20–75 | — |
| NaAS, $C_{12}$–$C_{14}$ (II) | — | 30–60 |
| Perfume, Pine Cone (P & G) | 9–25 | 9–14 |
| Dye, Acid Blue #9 | 2–5 | 2–5 |
| $Na_2SO_4$ | 3–30 | 3–30 |
| $H_2O$ | .5–7 | .5–3 |
| $Na_2CO_3$ | .5–5 | .5–5 |
| Cake Longevity in flushes- 70 flushes = 1 week at 16° C. | 200–400 flushes | 50–250 flushes |

TABLE 4

| Solid Surfactant Cake Ingredients | Optimum Compositions (%) I Mg-(AS)$_2$ | Optimum Compositions (%) II NaAS |
|---|---|---|
| Mg-(AS)$_2$, $C_{12}$–$C_{14}$ | 60.0 | — |
| NaAS | — | 67.7 |
| Perfume, Pine Cone (P & G) | 18.0 | 11.0 |
| Dye, Acid Blue #9 | 2.7 | 2.7 |
| $Na_2SO_4$ | 15.0 | 15.0 |
| $H_2O$ | 2.0 | 2.0 |
| $Na_2CO_3$ | 1.6 | 1.6 |
| Longevity of Cakes | 350 flushes | 200 flushes |

As illustrated above, the solid cakes comprising buffered magnesium alkyl sulfate are superior to NaAS based cakes longevitywise. Also, note increased ability to incorporate perfume.

What is claimed is:

1. A substantially stable solid cake comprising from 20% to 90% of an alkali earth metal alkyl sulfate, 0% to 30% perfume, 0% to 12% of a dye, 1% to 40% of a compatible water-soluble salt, and an effective amount of a buffer having a pKa of from 6 to 10; said cake weighing from 10 gms to 120 gms and having a density of 0.8 to 1.5, said cake having a pH of 6 to 10, said cake containing at least 1.5% of at least one of said perfume or dye.

2. The invention of claim 1 wherein said alkali earth metal alkyl sulfate is selected from the group consisting of magnesium alkyl sulfate, calcium alkyl sulfate, and barium alkyl sulfate.

3. The invention of claim 2 wherein said cake comprises 40% to 70% of said alkali earth metal alkyl sulfate, 10% to 20% perfume, 1.5% to 10% dye, and 5% to 18% water-soluble salt; said cake weighing from 20 gms to 100 gms and having a density of 1 to 1.3 gms/cc.

4. The invention of claim 3 wherein said alkali earth metal alkyl sulfate contains a carbon chain length of from 8 to 22 carbon atoms.

5. The invention of claim 4 wherein alkyl chain length is 10 to 16 carbon atoms.

6. The invention of claim 5 wherein said pH is 7 to 9.5.

7. The invention of claim 1 wherein said cake has a moisture content of 0.1% to 10%.

8. The invention of claim 7 wherein the moisture content is 1% to 5%.

9. A substantially stable solid cake comprising from 20% to 90% of a transition metal alkyl sulfate, 0% to 30% perfume, 0% to 40% of a compatible water-soluble salt, and 0% to 12% of a dye; said cake weighing from 10 gms to 120 gms and having a density of about 0.8 to about 1.5 wherein said cake contains at least 1.5% of at least one combination of perfume or dye.

10. The invention of claim 9 wherein said transition metal alkyl sulfate is selected from the group consisting of iron, copper, zinc, silver, and cadmium alkyl sulfates.

11. The invention of claim 10, wherein said cake comprises 40% to 70% of said alkyl sulfate, 10% to 20% perfume, 1.5% to 10% dye and 5% to 18% of a water-soluble salt.

12. The invention of claim 11 wherein said alkyl sulfate contains a carbon chain length of from 8 to 22 carbon atoms.

13. The invention of claim 12 wherein said alkyl chain length is 10 to 16 carbon atoms.

14. The invention of claim 13 wherein said pH is 7 to 9.5.

15. A substantially stable solid surfactant cake comprising from 20% to 90% of an anionic surfactant selected from the group consisting of aluminum alkyl sulfate, tin alkyl sulfate, lead alkyl sulfate, and barium alkyl sulfate; 1% to 40% of a compatible water-soluble salt; and an effective amount of a buffer having a pKa of from 6 to 10, said cake weighing from 10 gms to 120 gms and having a density of 0.8 to 1.5, said cake having a pH of 6 to 10, said cake containing at least 1.5% of at least one of said perfume or dye.

16. The invention of claim 15 wherein said cake comprises 40% to 70% of said alkyl sulfate, 10% to 20% perfume, 1.5% to 10% dye and 5% to 18% of a water-soluble salt.

17. The invention of claim 16 wherein said alkyl sulfate contains a alkyl carbon chain length of from 8 to 22 carbon atoms.

18. The invention of claim 17 wherein said alkyl chain length is 10 to 16 carbon atoms.

19. The invention of claim 18 wherein said pH is 7 to 9.5.

20. A substantially stable solid cake comprising from 20% to 90% of an alkali earth metal alkyl sulfate, 0% to 30% perfume, 0% to 12% of a dye, 1% to 40% of a compatible water-soluble salt, and an effective amount of a buffer having a pKa of from 6 to 10; said cake weighing from 10 gms to 120 gms and having a density of 0.8 to 1.5, said cake having a pH of 6 to 10 wherein said cake contains at least 10% of a combination of perfume, dye and water-soluble salt.

21. The invention of claim 20 wherein said cake contains at least 2% sodium alkyl sulfate.

22. A method of making stable solid alkali earth metal alkyl sulfate surfactant comprising reacting an alkali earth metal salt with an alkali metal alkyl sulfate salt in the presence of an effective amount of a buffer having a pKa of from 6 to 10; said alkali earth metal alkyl sulfate surfactant having a pH of from 6 to 10.

23. The invention of claim 22 wherein said pKa is from 7 to 9.5 and said pH is from 7 to 9.5.

24. The invention of claim 22 wherein said buffer is sodium carbonate used at a level of 0.5% to 3% by weight of the alkali earth metal alkyl sulfate.

25. The invention of claim 24 wherein said alkali earth metal sulfate is magnesium alkyl sulfate.

26. A method of making stable solid alkali earth metal alkyl sulfate comprising reacting an alkali earth metal salt with an alkyl sulfuric acid and buffering the reaction product with an effective amount of a suitable buffer having a pKa of 6 to 10 to provide a product having a pH of from 6 to 10.

27. The invention of claim 26 wherein said pKa is from 7 to 9.5 and said pH is from 7 to 9.5.

28. The invention of claim 27 wherein said alkali earth metal alkyl sulfate is magnesium alkyl sulfate.

29. The invention of claim 28 wherein said alkyl is lauryl.

30. The invention of claim 29 wherein said magnesium alkyl sulfate has a pH of from 6 to 10.

31. The invention of claim 30 wherein said pH is from 7 to 9.5.

32. The invention of claim 31, wherein said stable solid magnesium alkyl sulfate has a moisture content of from 0.1% to 10%.

33. The invention of claim 32 wherein said moisture content is 1% to 5%.

* * * * *